US009957946B2

(12) United States Patent
Kinoshita et al.

(10) Patent No.: US 9,957,946 B2
(45) Date of Patent: May 1, 2018

(54) IGNITION DEVICE

(71) Applicant: DENSO CORPORATION, Kariya, Aichi-pref. (JP)

(72) Inventors: Shota Kinoshita, Nishio (JP); Akimitsu Sugiura, Kariya (JP); Kaori Doi, Kariya (JP); Fumiaki Aoki, Nishio (JP)

(73) Assignee: DENSO CORPORATION, Kariya (JP)

( * ) Notice: Subject to any disclaimer, the term of this patent is extended or adjusted under 35 U.S.C. 154(b) by 0 days. days.

(21) Appl. No.: 15/468,424

(22) Filed: Mar. 24, 2017

(65) Prior Publication Data

US 2017/0276114 A1 Sep. 28, 2017

(30) Foreign Application Priority Data

Mar. 25, 2016 (JP) ..... 2016-062213

(51) Int. Cl.

| | |
|---|---|
| ***F02P 3/00*** | (2006.01) |
| ***F02P 13/00*** | (2006.01) |
| ***H05H 1/46*** | (2006.01) |
| ***F02P 3/05*** | (2006.01) |
| ***F02P 9/00*** | (2006.01) |
| ***F02P 15/10*** | (2006.01) |
| ***F02P 3/045*** | (2006.01) |
| ***F02P 15/00*** | (2006.01) |

(Continued)

(52) U.S. Cl.

CPC ..... *F02P 13/00* (2013.01); *F02P 3/0456* (2013.01); *F02P 3/05* (2013.01); *F02P 3/053* (2013.01); *F02P 9/002* (2013.01); *F02P 15/005* (2013.01); *F02P 15/10* (2013.01); *F02P 17/12* (2013.01); *H05H 1/46* (2013.01); *H05H 1/52* (2013.01)

(58) Field of Classification Search

CPC .. F02P 3/0456; F02P 3/05; F02P 3/053; F02P 9/002; F02P 15/005; F02P 15/10; F02P 17/12

USPC ..... 123/605, 618, 634

See application file for complete search history.

(56) References Cited

U.S. PATENT DOCUMENTS

| | | | | |
|---|---|---|---|---|
| 4,922,883 A * | 5/1990 | Iwasaki | F02P 15/10 | 123/598 |
| 7,895,994 B2 * | 3/2011 | Yamada | H01T 13/50 | 123/143 B |
| 9,777,695 B2 * | 10/2017 | Itoi | F02P 9/002 | |

(Continued)

*Primary Examiner* — Tung X Le

(74) *Attorney, Agent, or Firm* — Nixon & Vanderhye P.C.

(57) ABSTRACT

An ignition device includes a spark plug, a measurement value detector, an electrical breakdown determiner, an AC voltage applying section, and a first changing section. The measurement value detector includes primary and secondary coils, and detects at least one measurement value among an ignition coil, a primary current, a primary voltage, a secondary current, and a secondary voltage. The electrical breakdown determiner determines whether a discharge has become an electrical breakdown state based on the measurement value. The AC voltage applying section applies an AC voltage of a first predetermined frequency that causes voltage resonance to the primary coil. The first changing section changes the frequency of the AC voltage to a second predetermined frequency that can maintain the electrical breakdown state and is lower in frequency than the first predetermined frequency when it is determined that the discharge has become the electrical breakdown state.

11 Claims, 6 Drawing Sheets

(51) Int. Cl.
*F02P 17/12* (2006.01)
*H05H 1/52* (2006.01)

(56) References Cited

U.S. PATENT DOCUMENTS

| | | | | |
|---|---|---|---|---|
| 2013/0049593 | A1* | 2/2013 | Sugino | H05H 1/46<br>315/111.41 |
| 2013/0181629 | A1 | 7/2013 | Urushihara et al. | |
| 2015/0115827 | A1* | 4/2015 | Itoi | H05H 1/46<br>315/224 |

* cited by examiner

IGNITION DEVICE

CROSS-REFERENCE TO RELATED APPLICATION

This application is based on and claims the benefit of priority from earlier Japanese Patent Applications No. 2016-62213 filed Mar. 25, 2016, the description of which is incorporated herein by reference.

TECHNICAL FIELD

The present disclosure relates to an ignition device for an engine.

BACKGROUND

An ignition device of an engine stores magnetic energy in an ignition coil by supplying a primary current to a primary coil connected to a power source.

A secondary current generated in a secondary coil when the primary current is cut off is caused to flow in a gap formed between a center electrode and a ground electrode of a spark plug, thereby generating a plasma discharge in the gap of the spark plug.

At this time, it is possible to generate a plasma discharge (pulse discharge) effective for deodorization, sterilization, film formation, decomposition of harmful gas, ignition, etc. by applying a very high voltage pulse between the electrodes of the spark plug.

However, implementation of such a pulse discharge requires continuous supply of high voltage pulse at short cycles, and thus there is a problem that the supplied power is increased.

For this reason, it is disclosed in Japanese Patent No. 5,307,284 that a first pulse of high energy is applied until arc discharge (electrical breakdown) occurs between electrodes of a spark plug, and after the arc discharge has occurred between the electrodes of the spark plug, the arc discharge between the electrodes is maintained by applying a second pulse of low energy.

At this time, a peak voltage value of the second pulse is set to be lower than a peak voltage of the first pulse, and a pulse cycle of the second pulse is set to be shorter than a pulse cycle of the first pulse.

A pulse frequency of the second pulse should be high enough to maintain the arc discharge generated between the electrodes, and care should be taken so that power not be excessively consumed by making the pulse frequency too high.

By the second pulse thus adjusted being applied after the arc discharge has occurred between the electrodes of the spark plug, it is possible to reduce the power supply as well as to reduce the cost such as the running cost of the discharge device.

In Japanese Patent No. 5,307,284, for example, a case is supposed where the frequency of the first pulse is set to a frequency at which a voltage resonance in a circuit including the spark plug and the secondary coil becomes strongest (hereinafter referred to as a resonance frequency) or a frequency approximately equal thereto.

In this case, if the arc discharge occurs between the electrodes of the spark plug, impedance between the electrodes of the spark plug changes and the resonance frequency changes accordingly.

Therefore, if the first pulse is applied even after the arc discharge occurs, the secondary current flowing into the spark plug is insufficient because the voltage resonance does not occur or becomes weak, and there is a possibility that the arc discharge occurring in the spark plug to be in an unstable state.

In such a case, there is a possibility that the ignitability of the fuel deteriorates and the combustion state deteriorates.

SUMMARY

In an ignition device that applies an AC voltage of a frequency that causes resonance, an embodiment provides an ignition device capable of stably maintaining discharge even after the discharge occurring in a spark plug has become an electrical breakdown (discharge breakdown).

An aspect of an ignition device includes a spark plug that generates a plasma discharge between a pair of discharge electrodes for igniting a combustible mixture in a combustion chamber of an internal combustion engine and an ignition coil having a primary coil and a secondary coil that applies a voltage between the pair of discharge electrodes of the spark plug by the secondary coil.

The ignition device further includes a measurement value detecting section that detects at least one measurement value among a primary current flowing through the primary coil, a primary voltage applied to the primary coil, a secondary current flowing through the ignition plug, and a secondary voltage applied to the spark plug, and an electrical breakdown determiner that determines whether or not a discharge between the pair of discharge electrodes has become an electrical breakdown state based on the measurement value detected by the measurement value detecting section.

The ignition device further includes an AC voltage applying section that applies an AC voltage of a first predetermined frequency, which causes voltage resonance in a circuit including the spark plug and the secondary coil, in the primary coil, and a first changing section that changes the frequency of the AC voltage outputted by the AC voltage applying section to a second predetermined frequency that can maintain the electrical breakdown state, and the second predetermined frequency being lower in frequency than the first predetermined frequency when it is determined by the electrical breakdown determiner that the discharge has become the electrical breakdown state.

According to the above configuration, it is determined whether or not the discharge between the pair of discharge electrodes has become the electrical breakdown state by the electrical breakdown determiner based on the measurement value detected by the measurement value detecting section.

In the present ignition device, when it is determined by the electrical breakdown determiner that the discharge has become the electrical breakdown state, the frequency of the AC voltage outputted by the AC voltage applying section is changed by the first changing section.

The frequency of the AC voltage outputted by the AC voltage applying section is set to the first predetermined frequency that causes voltage resonance in the circuit including the spark plug and the secondary coil.

For this reason, the voltage applied between the discharge electrodes of the spark plug is amplified by the voltage resonance until it is determined by the electrical breakdown determiner that the discharge has become the electrical breakdown state.

However, the impedance between the electrodes changes and the resonance frequency changes when the discharge occurring in the spark plug becomes the electrical breakdown state.

Therefore, when the AC voltage of the first predetermined frequency is applied to the primary coil even after the discharge occurring in the spark plug becomes the electrical breakdown state, the voltage resonance cannot occur or the voltage resonance becomes weak, and there is a possibility that the secondary current required for maintaining the discharge that has become electrical breakdown cannot be applied to the ignition plug.

In preparation for this, when it is determined by the electrical breakdown determiner that the spark plug has produced a state of full electrical breakdown between the electrodes, a frequency of the AC voltage is changed, by the first changing section, to the second predetermined frequency that can maintain the electrical breakdown state, and is lower in frequency than the first predetermined frequency.

The impedance of the ignition coil decreases as the frequency of the AC voltage decreases.

Therefore, by changing the frequency of the AC voltage to the second predetermined frequency, it is possible to increase the secondary current flowing into the spark plug, the resonance frequency changes as the discharge becomes the electrical breakdown state, and it is possible to maintain the electrical breakdown state when the voltage resonance becomes weak.

However, if the frequency of the AC voltage is too low, there is a possibility that the power supply to the spark plug is insufficient and the electrical breakdown state cannot be maintained, thus the frequency is set to be high enough to maintain the electrical breakdown state.

In this way, by controlling the discharge to continue the electrical breakdown state, it is possible to ignite the fuel stably.

DETAILED DESCRIPTION OF THE PREFERRED EMBODIMENTS

The present embodiment will be described with reference to the drawings.

Figure 1:
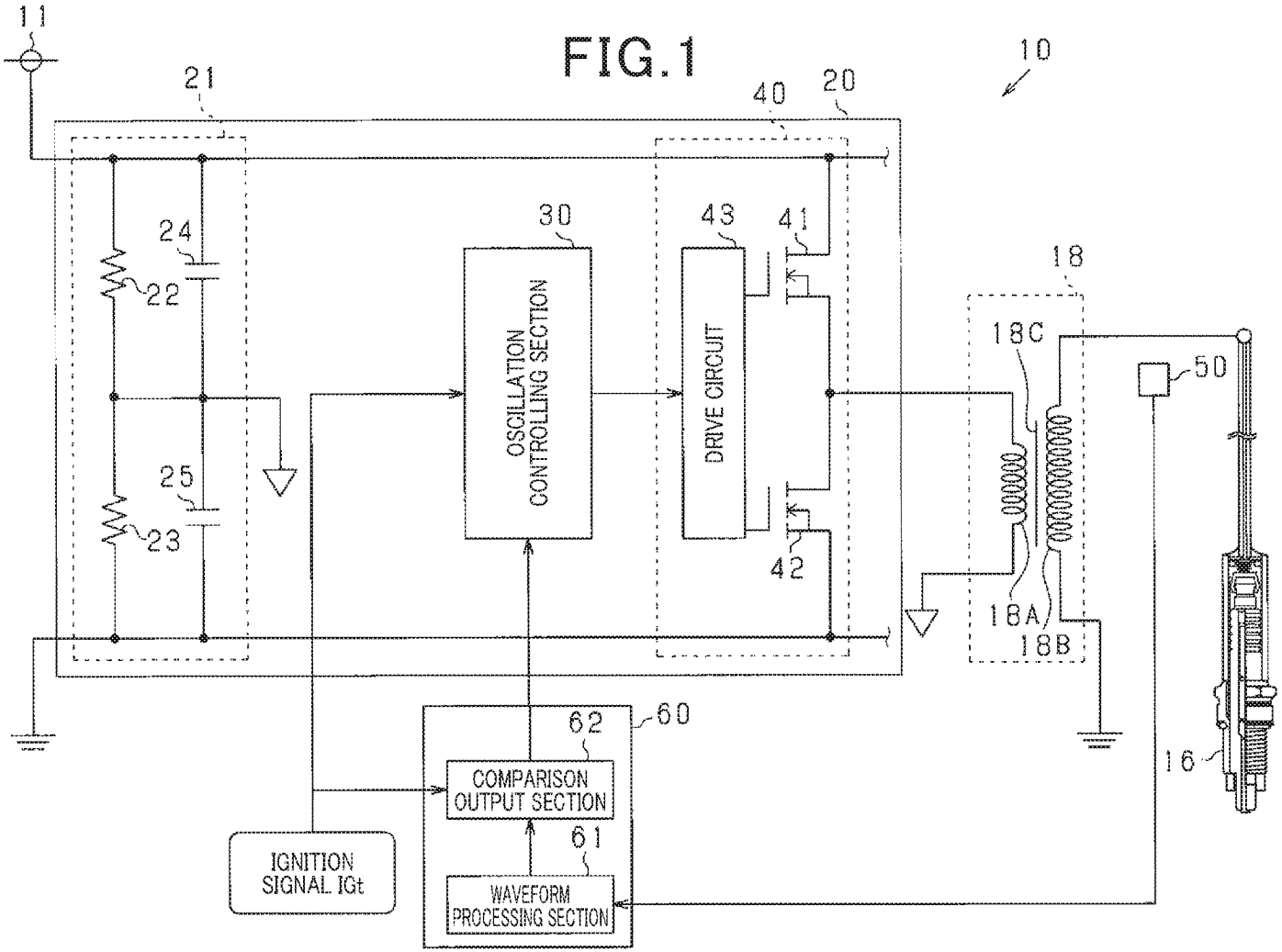
FIG. 1 shows a schematic configuration diagram of an ignition control system according to the present embodiment.

An ignition device for an engine, or more specifically, an ignition control system 10 shown in FIG. 1, is provided with an ignition coil 18, a spark plug 16, a high frequency power supply section 20, and a power supply section 11.

The ignition coil 18 includes a primary coil 18A, a secondary coil 18B, and an iron core 18C.

A first end of the primary coil 18A is connected to an output terminal of the high frequency power supply section 20. The high frequency power supply section 20 converts a voltage outputted from the power supply section 11 into an AC voltage for applying to the primary coil 18A.

On the other hand, a first end of the secondary coil 18B is connected to an input terminal of the spark plug 16.

A second end of the secondary coil 18B is grounded to a ground potential.

That is, the secondary coil 18B is connected to the spark plug 16, and a high voltage is applied to the spark plug 16 from the secondary coil 18B.

The high frequency power supply section 20 includes a power supply voltage dividing section 21, an oscillation controlling section 30, and a switching section 40.

The power supply voltage dividing section 21 includes a serial connection body of resistors 22, 23, and a serial connection body of capacitors 24, 25.

A path connecting the resistor 22 and the resistor 23, and a path connecting the capacitor 24 and the capacitor 25 are connected by a path having the same potential as the second end of the primary coil 18A.

In addition, a predetermined voltage V is applied from the power supply section 11 to one end of the resistor 22 and one end of the capacitor 24, and one end of the resistor 23 and one end of the capacitor 25 are grounded.

The oscillation controlling section 30 generates a square wave voltage signal that changes to H level and L level.

In the present embodiment, the voltage signal is generated so that the frequency of the AC voltage becomes a first predetermined frequency fA.

The first predetermined frequency fA is set to a frequency (resonance frequency) at which voltage resonance occurring in a circuit including the spark plug 16 and the secondary coil 18B becomes the strongest.

The oscillation controlling section 30 generates a first drive signal and a second drive signal based on the generated voltage signal so that a later-described first switching element 41 and a second switching element 42 alternately perform opening and closing operations.

Then, the oscillation controlling section 30 transmits the first drive signal and the second drive signal to a drive circuit 43 included in the switching section 40 by receiving an ignition signal IGt.

The switching section 40 includes the first switching element 41 and the second switching element 42 in addition to the drive circuit 43.

The drive circuit 43 controls the first switching element 41 and the second switching element 42 based on the first drive signal and the second drive signal, respectively, received from the oscillation controlling section 30.

By this control, for example, when the first switching element 41 is controlled to be turned on and the second switching element 42 is controlled to be turned off, +V voltage (positive voltage) is applied to the primary coil 18A from the power supply section 11.

On the other hand, when the first switching element 41 is controlled to be turned off and the second switching element 42 is controlled to be turned on, a −V voltage (negative voltage) is applied to the primary coil 18A by the capacitor 25.

Therefore, by switching on/off of the first switching element 41 and the second switching element 42, the positive voltage and the negative voltage are alternately applied to the primary coil 18A.

That is, an AC voltage is applied to the primary coil 18A.

Figure 2:
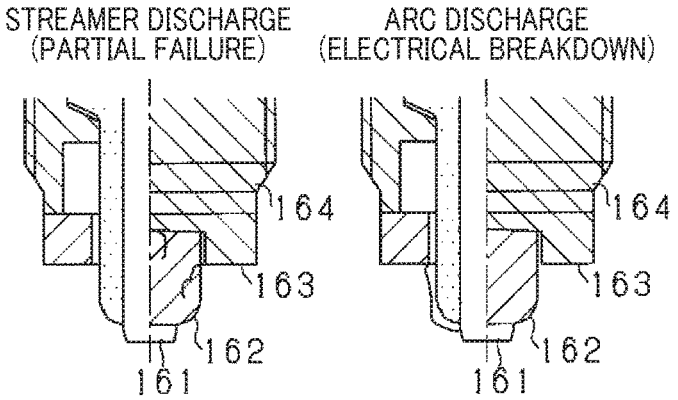
FIG. 2 shows sectional views showing a difference between a creeping streamer discharge and a creeping arc discharge.

Regarding the spark plug 16, a schematic configuration will be described with reference to FIG. 2.

The spark plug 16 includes a center electrode 161, an insulator 162, a ground electrode 163, and a housing 164.

The insulator 162 covers an outer periphery of the center electrode 161 and secures electrical insulation between the center electrode 161, the housing 164, and the ground electrode 163.

A proximal end side (upper side in the drawing) of the insulator 162 is crimped and fixed by the housing 164.

Then, a space (discharge space) for electrical discharge is defined between the insulator 162 exposed from the housing 164 and the ground electrode 163, and a creeping streamer discharge occurs in the discharge space.

The creeping streamer discharge occurs in the discharge space so as to extend from a surface of the ground electrode 163 along the insulator 162 toward the center electrode 161.

When the creeping streamer discharge is continued, the discharge is elongated so as to creep across a surface of the insulator 162, and a part of the discharge reaches a tip of the center electrode 161 (an electrical breakdown state). It should be noted that a fact that the electrodes in the gas are connected by a conductive discharge path is hereinafter defined as an electrical breakdown.

When the discharge becomes the electrical breakdown state, a creeping arc discharge is formed between the ground electrode 163 and the center electrode 161 (hereinafter referred to as between discharge electrodes).

In the present embodiment, the oscillation controlling section 30 receives the ignition signal IGt and transmits the first drive signal and the second drive signal to the drive circuit 43, so that the AC voltage being set to the first predetermined frequency fA is supplied to the primary coil 18A.

For this reason, the secondary voltage applied to the center electrode 161 and the ground electrode 163 is amplified by the voltage resonance until the discharge occurring in the spark plug 16 becomes the electrical breakdown state.

However, impedance between the discharge electrodes changes and the resonance frequency changes accordingly when the discharge occurring in the spark plug 16 becomes the electrical breakdown state.

Therefore, when the AC voltage of the first predetermined frequency fA is applied to the primary coil 18A even after the discharge occurring in the spark plug 16 has become the electrical breakdown state, voltage resonance cannot be generated or the voltage resonance becomes weak.

Figure 3:
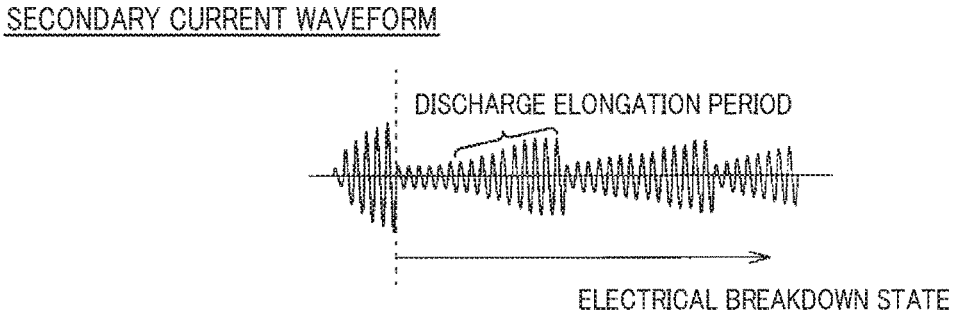
FIG. 3 shows a diagram showing a transition of a secondary current flowing through a spark plug in a normal state.

FIG. 3 shows an example in which the AC voltage of the first predetermined frequency fA is applied even after the discharge has become the electrical breakdown state.

The secondary current flowing between the discharge electrodes when the discharge becomes the electrical breakdown state is greatly reduced as compared with a case before the electrical breakdown, and since the reduced secondary current is not amplified during a period until the discharge is elongated (described later), it can be seen that the voltage resonance is not occurring.

At this time, depending on a reduction degree of the secondary current caused by the discharge becoming the electrical breakdown state, there is a possibility that the discharge that has become the electrical breakdown state cannot be maintained.

In preparation for this, in the present embodiment, the ignition control system 10 shown in FIG. 1 is provided with a secondary current sensor (corresponding to a measurement value detecting section) 50 and a discharge state determiner 60.

The secondary current sensor 50 is disposed in a current path connecting the first end of the secondary coil 18B and the input terminal of the spark plug 16, and detects the secondary current flowing into the spark plug 16.

Then, a detection result of the secondary current is outputted to a waveform processing section 61 included in the discharge state determiner 60.

The discharge state determiner 60 includes the waveform processing section 61 and a comparison output section 62.

The waveform processing section 61 creates an envelope from the detection result of the secondary current outputted by the secondary current sensor 50.

Figure 4:
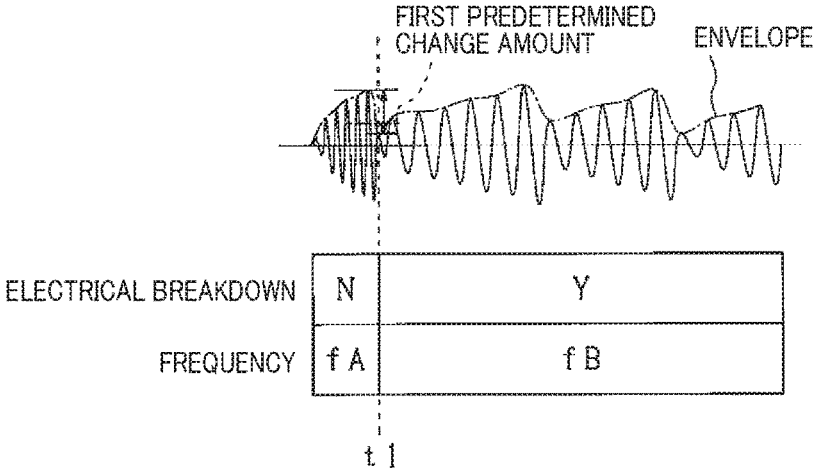
FIG. 4 shows a diagram showing a transition of the secondary current flowing into the spark plug when a frequency change control according to the present embodiment is implemented.

More specifically, as shown in FIG. 4, a tangent line that makes contact with all the maximum peaks appearing during the AC voltage application period is formed as the envelope.

Therefore, the waveform processing section 61 corresponds to an envelope acquiring section.

Then, by receiving the ignition signal IGt, the comparison output section 62 determines whether or not a change amount per unit time of the envelope created by the waveform processing section 61 is greater than a first predetermined change amount.

A determination result by the comparison output section 62 is outputted to the oscillation controlling section 30, and the oscillation controlling section 30 determines whether the discharge has become the electrical breakdown state or not based on the determination result by the comparison output section 62.

Therefore, the oscillation controlling section 30 and the comparison output section 62 correspond to an electrical breakdown determiner.

Whether or not the discharge has become the electrical breakdown state can be determined from the reduction degree of the secondary current.

When the AC voltage of the first predetermined frequency fA is applied in a state where the discharge has not become the electrical breakdown state, the secondary current flowing into the spark plug 16 is amplified by a resonance action.

However, due to the discharge becoming the electrical breakdown state, the resonance frequency changes, and the secondary current amplified by the voltage resonance decreases accordingly.

Since the reduction of the secondary current is characteristic in determining whether or not the discharge becomes the electrical breakdown, the first predetermined change amount is set to a value for identifying the reduction degree of the secondary current when the discharge has become the electrical breakdown.

The oscillation controlling section 30 according to the present embodiment does not perform the determination as to whether or not the discharge has become the electrical breakdown state after it is determined that the discharge has become the electrical breakdown during a reception period of the ignition signal IGt.

In order to be described in detail later, a brief description will be given here. The discharge that has become the electrical breakdown state may be elongated due to an influence of an air current in a cylinder, and the secondary current required to maintain the discharge increases due to the elongation of the discharge.

However, the discharge may not necessarily continue to lengthen, but sometimes the discharge may instead be shortened.

In this case, the secondary current that has continued to increase due to the elongation of the discharge decreases as the discharge becomes shorter.

A change amount in the secondary current generated at this time may be larger than the first predetermined change amount, and when a determination of whether or not the discharge has become the electrical breakdown state is performed after the discharge has become the electrical breakdown, there is a possibility of erroneously determining that the electrical breakdown is no longer occurring when such a phenomenon occurs.

Based on the above, in the present embodiment, while receiving the ignition signal IGt, in a state in which the discharge has not been determined to have become the electrical breakdown state, the comparison output section 62 determines whether or not the change amount per unit time of the envelope created by the waveform processing section 61 is greater than a first predetermined change amount.

Then, the oscillation controlling section 30 determines that the discharge has become the electrical breakdown state under the condition that the change amount per unit time of the envelope per unit time is greater than the first predetermined change amount is determined by the comparison output section 62.

The oscillation controlling section 30 changes a frequency of the AC voltage applied to the primary coil 18A based on a determination as to whether or not the discharge has become the electrical breakdown state.

Specifically, as described in FIG. 4, the oscillation controlling section 30 controls the frequency of the AC voltage to the first predetermined frequency fA as the discharge has not become the electrical breakdown state yet until the change amount per unit time of the envelope is determined to be greater than the first predetermined change amount by the comparison output section 62.

Then, when it is determined by the comparison output section 62 that the change amount per unit time of the envelope is greater than the first predetermined change amount (refer to time t1), the oscillation controlling section 30 determines that the discharge has become the electrical breakdown state, and controls the frequency of the AC voltage to a second predetermined frequency fB which is lower than the first predetermined frequency fA.

Therefore, the oscillation controlling section 30 corresponds to an AC voltage applying section and a first changing section.

As commonly known, when the AC voltage is applied to the primary coil 18A, a counter electromotive force is generated in the primary coil 18A, and this counter electromotive force acts as an electric resistance (impedance).

Figure 5:
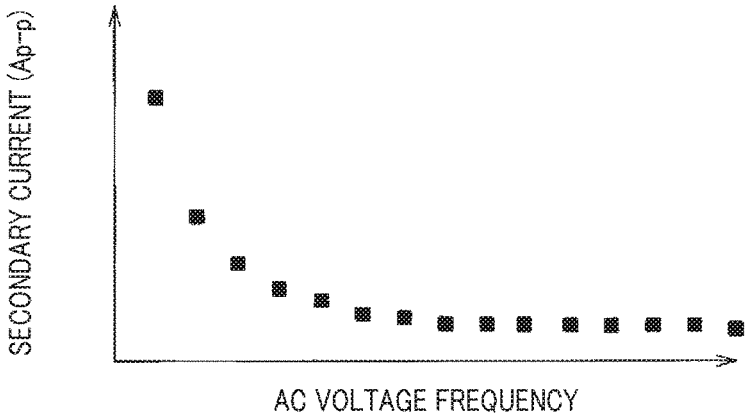
FIG. 5 shows a diagram of a relationship between a frequency of an AC voltage and the secondary current flowing into the spark plug.

Since this electric resistance works as a small resistance as the frequency of the AC voltage is lower, the secondary current flowing into the spark plug 16 increases as the frequency of the AC voltage decreases, as shown in FIG. 5.

Therefore, by changing the frequency of the AC voltage to the second predetermined frequency fB when the discharge becomes the electrical breakdown state, it is possible to increase the secondary current flowing into the spark plug 16, and the electrical breakdown state can be maintained.

However, there is a possibility that the power supplied to the spark plug 16 is insufficient and the electrical breakdown state cannot be maintained if the frequency of the AC voltage is too low, so that the frequency is set to be high enough to maintain the electrical breakdown state.

In the present embodiment, the oscillation controlling section 30 executes a frequency change control in FIG. 6 which will be described hereinafter.

Figure 6:
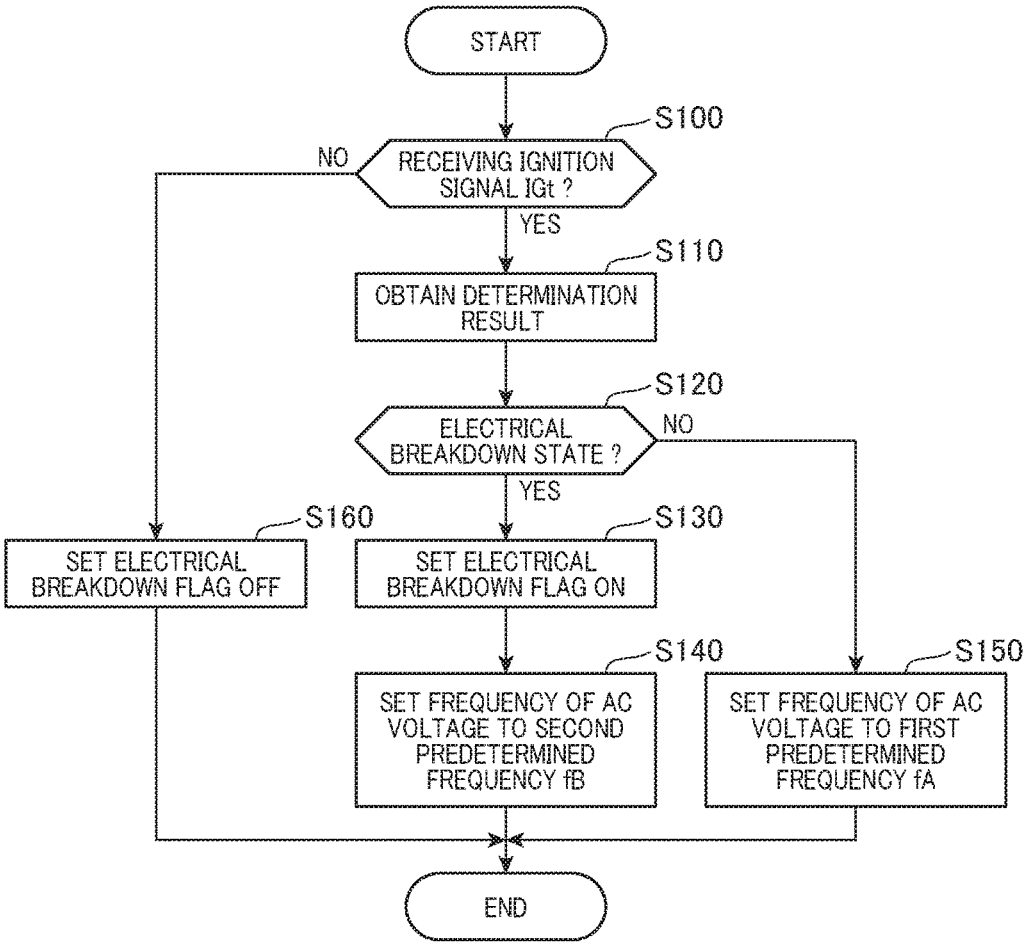
FIG. 6 shows a flowchart showing a processing procedure of the frequency change control according to the present embodiment.

The frequency change control shown in FIG. 6 is repeatedly executed at predetermined intervals by the oscillation controlling section 30 while the oscillation controlling section 30 is powered on.

In step S100, it is determined whether or not the ignition signal IGt is being received.

If it is determined that the ignition signal IGt is being received (step S100: YES), the process proceeds to step S110.

In step S110, a determination result as to whether or not the change amount per unit time of the envelope generated by the waveform processing section 61 is larger than the first predetermined change amount is obtained from the comparison output section 62.

In step S120, it is determined whether or not the discharge has become the electrical breakdown based on the determination result obtained from the comparison output section 62, and it is also determined whether or not an electrical breakdown flag is set to ON.

If it is determined from the determination result obtained from the comparison output section 62 that the discharge has become the electrical breakdown, or if it is determined that the electrical breakdown flag is set to ON (S120: YES), the process proceeds to step S130, and sets the electrical breakdown flag to ON.

Then, in step S140, the frequency of the AC voltage is set to the second predetermined frequency fB, and the present control is terminated.

If it is determined from the determination result obtained from the comparison output section 62 that the discharge has not become the electrical breakdown and that the electrical breakdown flag is set to OFF (S120: NO), the process proceeds to step S150, and sets the frequency of the AC voltage to the first predetermined frequency fA (maintains the frequency of the AC voltage at the first predetermined frequency fA). Then, present control is terminated.

If it is determined that the ignition signal IGt has not been received (step S100: NO), the process proceeds to step S160, and the electrical breakdown flag is set to OFF, then the present control is terminated.

With the above configuration, the present embodiment has the following effects.

(1) The resonance frequency changes by the discharge becoming the electrical breakdown state, and the frequency of the AC voltage is changed to the second predetermined frequency fB by the oscillation controlling section 30 in a situation where the voltage resonance becomes weak, whereby the secondary current flowing into the ignition plug 16 can be increased, and it is possible to maintain the electrical breakdown state.

On the other hand, if the frequency of the AC voltage is too low, there is a possibility that the power supplied to the spark plug 16 is insufficient and it is not possible to maintain the electrical breakdown state, so that it is set to a frequency high enough to maintain the electrical breakdown state.

In this way, by controlling the discharge that has become the electrical breakdown to be maintainable, it is possible to ignite the fuel stably.

Figure 7:
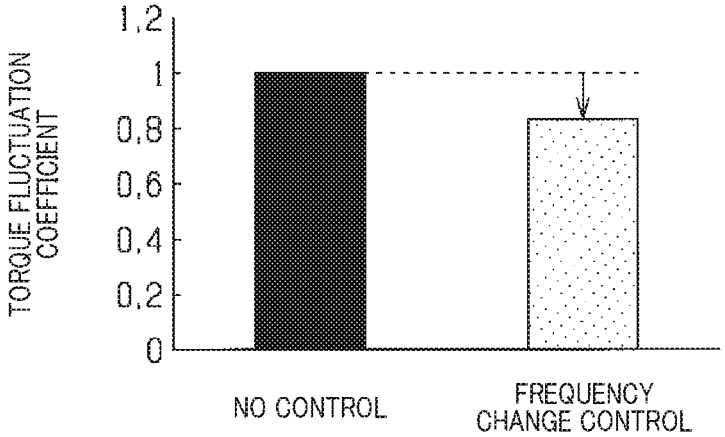
FIG. 7 shows a diagram showing an effect obtained by the frequency change control according to the present embodiment.

As a result, as shown in FIG. 7, an engine torque can be suppressed from varying as compared with a case where the frequency change control according to the present embodiment is not implemented.

(2) It is possible to read a state change of the discharge occurring between the discharge electrodes from the change of the envelope created by the waveform processing section 61.

More specifically, in a state where it is not determined that the discharge has become the electrical breakdown state during the reception of the ignition signal IGt, it can be determined that the discharge has become the electrical breakdown state under the condition that the change amount per unit time of the acquired envelope is greater than the first predetermined change amount.

(3) When detecting the secondary current, the influence of a power loss in a transformation with a transformer is small compared with a case where the primary current is detected, so that the secondary current flowing between the discharge electrodes can be measured more accurately.

For this reason, more accurate determination can be made, so that the accuracy of determination can be improved.

The above embodiment may be modified as follows.

(a) The first predetermined frequency fA is set to the resonance frequency in the above embodiment.

Regarding this, not only the resonance frequency but also a frequency at which a voltage gain exceeds 1 may be regarded as a frequency at which the voltage resonance occurs, and it may be set as the first predetermined frequency fA.

(b) It has been determined based on the secondary current detected by the secondary current sensor 50 whether or not the discharge has become the electrical breakdown state in the above embodiment.

In this regard, there is no need to necessarily provide the secondary current sensor 50, but instead a secondary voltage sensor may be provided to detect the secondary voltage applied to the spark plug 16.

In this case, it is possible to determine whether or not the discharge has become the electrical breakdown state by a determination method according to the determination method described in the above embodiment as well.

Alternatively, a primary current sensor for detecting the primary current flowing through the primary coil 18A may be provided.

Further alternatively, a primary voltage sensor for detecting the primary voltage applied to the primary coil 18A may be provided.

Even in this case, it is possible to determine whether or not the discharge has become the electrical breakdown state by a determination method according to the determination method described in the above embodiment.

(c) The waveform processing section 61 creates the tangent line which is in contact with all the maximum peaks appearing during the AC voltage application period as the envelope in the above embodiment.

With respect to this, a tangent line in contact with all the minimum peaks appearing during the AC voltage application period may be created as an envelope.

Alternatively, absolute values of the secondary current detected by the secondary current sensor 50 may be calculated, and a tangent line in contact with all the peaks thereof may be created as an envelope.

In this case, an envelope is created which is in contact with the peaks obtained by adding the absolute values of the maximum peaks and the absolute values of the minimum peaks of the secondary current.

Therefore, magnitudes of the peaks are doubled as compared with the envelope which is in contact with only the maximum peaks generated in the above embodiment, so that it is possible to make a more accurate determination.

(d) The oscillation controlling section 30 determines that the discharge has become the electrical breakdown state under the condition that the comparison output section 62 determines that the change amount per unit time of the envelope is greater than the first predetermined change amount in the above embodiment.

Regarding the method of determining the electrical breakdown state of the discharge, the electrical breakdown state of the discharge may be determined by providing a first threshold value and a second threshold value that is set lower than the first threshold value, for example.

At this time, a difference between the first threshold value and the second threshold value is set to correspond to the first predetermined change amount.

Then, the oscillation controlling section 30 determines that the discharge has become the electrical breakdown state by the comparison output section 62 determining that the envelope has changed from a state of being larger than the first threshold value to a state of being smaller than the second threshold value.

Alternatively, it may be determined whether or not the discharge has become the electrical breakdown state without using the envelope.

For example, a change amount of the maximum peak of the current secondary current with respect to the maximum peak of the most recent secondary current is calculated from the waveform of the secondary current detected by the secondary current sensor 50.

Then, it is determined that the discharge has become the electrical breakdown state under the condition that the calculated change amount is larger than the first predetermined change amount.

(e) The frequency of the AC voltage applied to the primary coil 18A is set to the second predetermined frequency fB when it is determined that the discharge has become the electrical breakdown state in the above embodiment.

Regarding this, when it is determined that the discharge has become the electrical breakdown state, it is not necessary to set the frequency of the AC voltage immediately to the second predetermined frequency fB. Examples in this regard are given below.

Example 1

The discharge that has become the electrical breakdown may be elongated due to the influence of the air current in the cylinder.

The secondary current required to maintain the discharge increases as the discharge elongates.

In this case, there is a possibility that the elongated discharge cannot be maintained even if the AC voltage of the first predetermined frequency fA with the lowered resonance action is applied to the primary coil 18A.

On the other hand, the secondary current required to maintain the discharge becomes the minimum when the discharge does not elongate and the discharge is occurring at the shortest distance between the discharge electrodes.

That is, in a state where the discharge is not elongated, it is conceivable that the discharge can be maintained even with the AC voltage of the first predetermined frequency fA.

With this in mind, after it is determined that the discharge has become the electrical breakdown state, the oscillation controlling section 30 determines whether or not the discharge that has become the electrical breakdown state is in the elongated state based on a determination result of the comparison output section 62 which will be described later.

Then, the frequency of the AC voltage applied to the primary coil 18A is changed depending on whether or not the discharge that has become the electrical breakdown state is in the elongated state.

Figure 8:
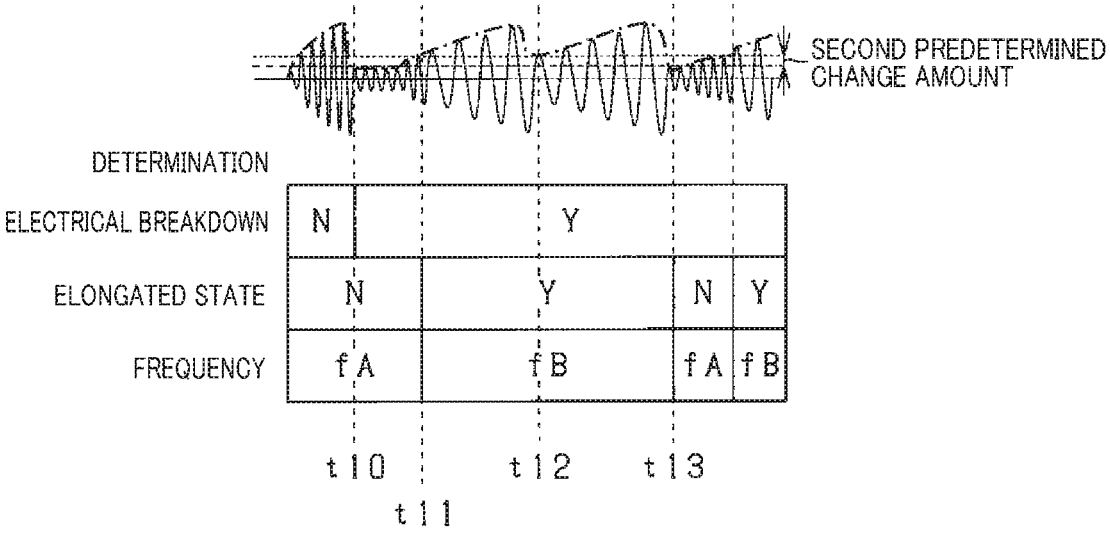
FIG. 8 shows a diagram showing a transition of the secondary current flowing into the spark plug when a frequency change control according to another example is implemented.

Specifically, as described in FIG. 8, under the condition that the oscillation controlling section 30 determines that the discharge is not in the elongated state even if the discharge becomes the electrical breakdown state, the oscillation controlling section 30 applies the first predetermined time AC voltage of frequency fA to the primary coil 18A during the condition period (refer to time t10-t11).

Then, under the condition that it is determined that the discharge is in the elongated state, the oscillation controlling section 30 changes the frequency of the AC voltage to the second predetermined frequency fB.

The method of determining the elongation state of the discharge is as follows.

As the degree of elongation of the discharge increases, the secondary current required to maintain the discharge also rises.

Along with this, the secondary current flowing between the discharge electrodes also rises in order to maintain the discharge.

At this time, as shown in FIG. 3, the change amount per unit time of the secondary current accompanying the discharge elongation is assumed to be smaller than the change amount of the secondary current generated when the discharge has become the electrical breakdown state.

Therefore, the second predetermined change amount provided for determining the discharge elongation is set to a smaller change amount as compared with the first predetermined change amount.

In addition, the increase in secondary current accompanying discharge elongation is accompanied by the passage of time.

Therefore, as shown in FIG. 8, a value of the envelope measured when it is determined that the discharge has become electrical breakdown is defined as an initial value, and the comparison output section 62 determines whether or not the change amount of the envelope with respect to the initial value is greater than the second predetermined change amount.

Then, when it is determined by the comparison output section 62 that the change amount of the envelope with respect to the initial value is larger than the second predetermined change amount, the oscillation controlling section 30 is possible to determine that the discharge is in the elongated state based on the determination result.

Therefore, the oscillation controlling section 30 and the comparison output section 62 according to the first embodiment correspond to an elongation state determiner.

Note that although the secondary current flowing between the discharge electrodes increases as the elongation state of the discharge that has become the electrical breakdown state progresses, the secondary current does not become infinitely large, but the secondary current may become small (for example, refer to times t12 and t13).

This is because if there exists a portion where the distance between a discharge occurring on the center electrode 161 side and a discharge occurring on the ground electrode 163 side is short, the discharges are joined at this portion and elongated portions of the discharge after the joined position disappear.

Therefore, the degree of elongation of the discharge becomes small, and the secondary current flowing between the discharge electrodes decreases accordingly.

At this time, when the secondary current decreases as the change amount of the envelope with respect to the initial value becomes smaller than the second predetermined change amount, the frequency of the AC voltage is changed to the first predetermined frequency fA (refer to time t13).

A frequency change control according to [Example 1] will be described with reference to FIG. 9.

Figure 9:
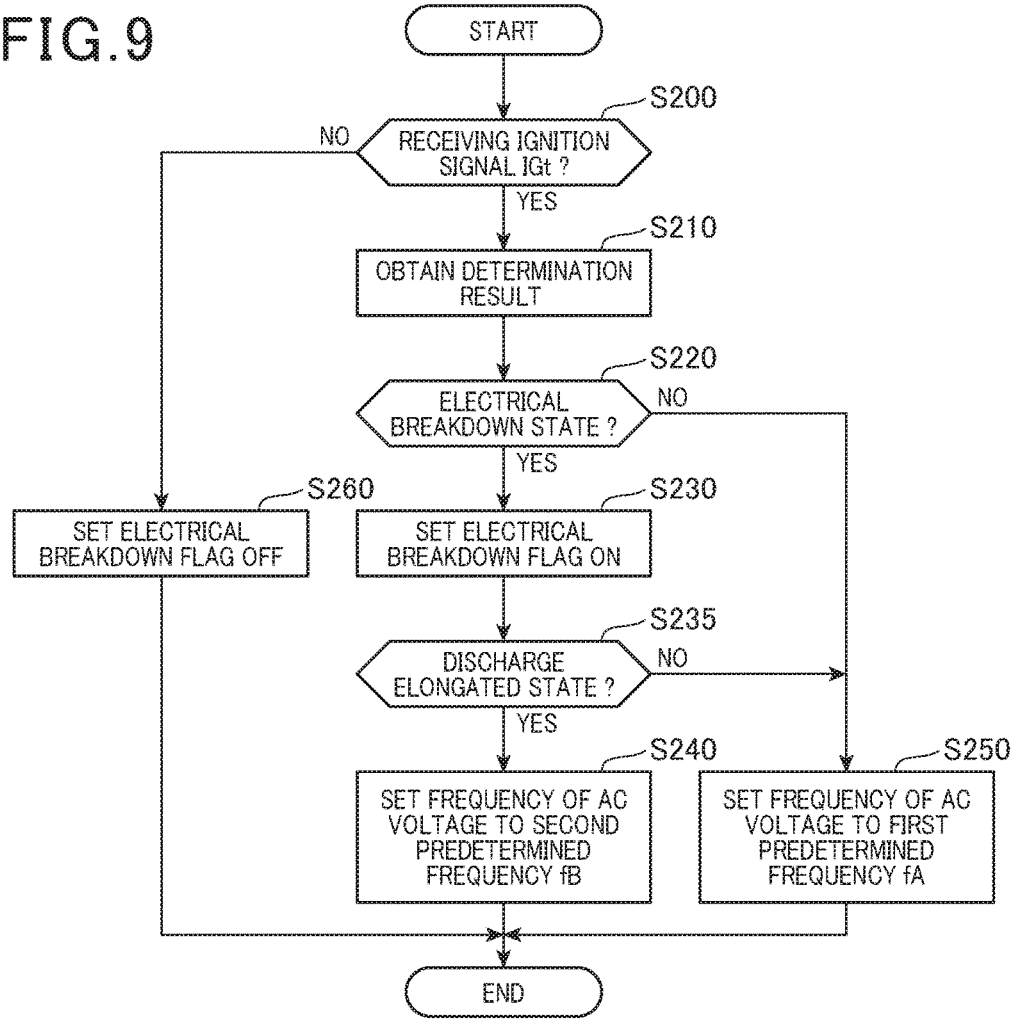
FIG. 9 shows a flowchart showing a processing procedure of the frequency change control shown in FIG. 8.

FIG. 9 is a flowchart of which a part of the flowchart of FIG. 6 is modified.

That is, step S235 is newly added between step S230, which corresponds to step S130, and step S240, which corresponds to step S140.

Specifically, step S235 is a step executed after setting the electrical breakdown flag to ON (step S230).

In step S235, it is determined whether the discharge that has become the electrical breakdown state is in the elongated state based on the determination result of the comparison output section 62.

If it is determined that the discharge that has become the electrical breakdown state is in the elongated state (S235: YES), the process proceeds to step S240.

If it is determined that the discharge that has become the electrical breakdown state is not in the elongated state (S235: NO), the process proceeds to step S250, which corresponds to step S150.

Regarding the other steps, the processing in each of steps S200, S210, S220, and S260 in FIG. 9 is the same as the processing in steps S100, S110, S120, and S160 in FIG. 6, respectively.

By implementing the frequency change control according to this specific example, the secondary current flowing into the spark plug 16 can be increased by applying the AC voltage of the second predetermined frequency fB to the spark plug 16 even if the discharge that has become the electrical breakdown is elongated and the secondary current required for maintaining the discharge increases.

Therefore, it is possible to stably maintain the elongated discharge.

As a result, since the elongated discharge can contact the injected fuel at a high frequency, the ignitability of the fuel can be improved.

In addition, since the AC voltage of the first predetermined frequency fA is applied until it is determined that the discharge is in the elongated state, it is possible to keep the magnitude of the AC voltage at the beginning of the discharge elongation to be small compared to the frequency change control described in FIG. 4 in the above embodiment.

As a result, the maximum peak of the AC voltage during the discharge elongation period can be kept low.

Example 2

In the example described in [Example 1], the AC voltage of the first predetermined frequency fA is applied to the primary coil 18A under the condition that it is determined that the discharge is not in the elongated state even when the discharge becomes the electrical breakdown state.

Regarding this, the AC voltage may be set to a third predetermined frequency fC which is a frequency higher than the first predetermined frequency fA under the condition that it is determined that the discharge is not in the elongated state even if the discharge becomes the electrical breakdown state.

However, as shown in FIG. 5, the secondary current flowing between the discharge electrodes of the spark plug 16 becomes small if the frequency of the AC voltage is too high, and there is a possibility that the discharge that has become the electrical breakdown state cannot be maintained.

For this reason, the third predetermined frequency fC is set to a low frequency to the extent that the electrical breakdown state of the discharge can be maintained.

Figure 10:
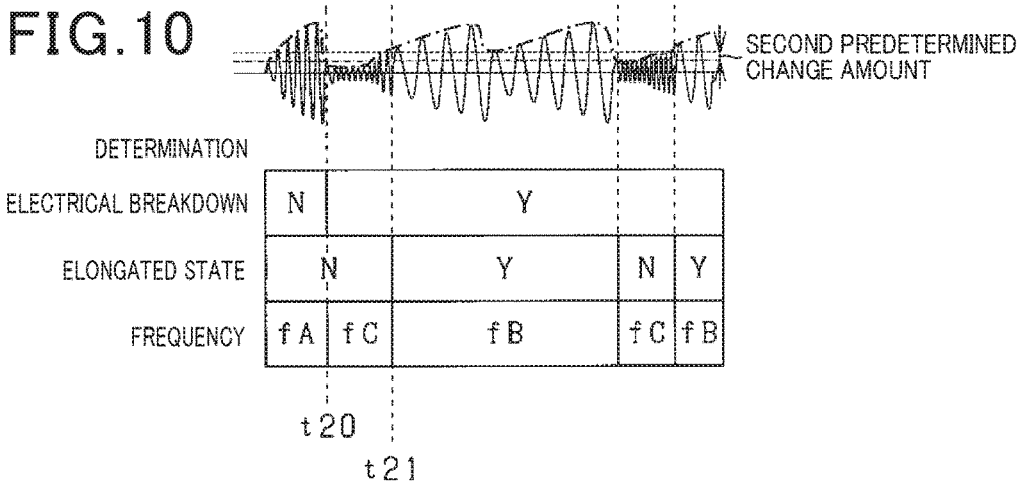
FIG. 10 shows a diagram showing a transition of the secondary current flowing into the spark plug when a frequency change control according to yet another example is implemented.

As shown in FIG. 10, the third predetermined frequency fC is applied to the primary coil 18A by the oscillation control portion 30 during a period from the time when the discharge becomes the electrical breakdown state to the time when it is determined that the discharge is in the elongated state (refer to time t20-t21).

For this reason, the oscillation controlling section 30 according to the present example (Example 2) corresponds to a second changing section.

A frequency change control according to [Example 2] will be described with reference to FIG. 11.

Figure 11:
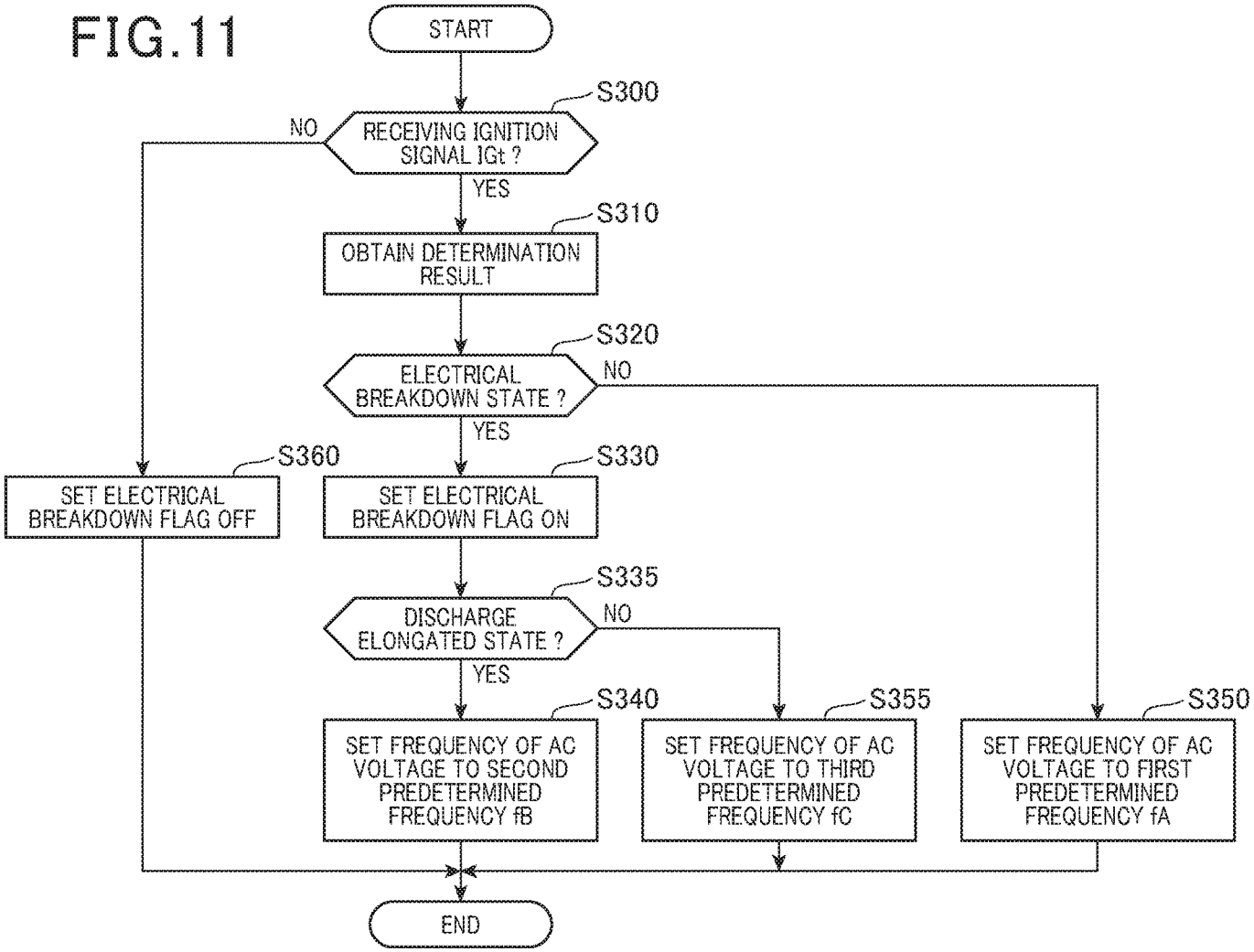
FIG. 11 shows a flowchart showing a processing procedure of the frequency change control shown in FIG. 10.

FIG. 11 is a flowchart of which a part of the flowchart of FIG. 9 is modified.

That is, if it is determined NO in step S335, which corresponds to step S235, step S355, which is a new step, is executed.

Specifically, when it is determined that the discharge that has become the electrical breakdown state is not in the elongated state (S335: NO), the process proceeds to step S355, then the frequency of the AC voltage is set to the third predetermined frequency fC, and the present control is terminated.

For the other steps, the processes in steps S300, S310, S320, S330, S340, S350, and S360 in FIG. 11 are the same as steps S200, S210, S220, S230, S240, S250, and S260, respectively.

It is assumed that the discharge upon complete electrical breakdown occurring is adhered to the insulator 162 of the spark plug 16.

At this time, when the secondary current flowing between the discharge electrodes of the spark plug 16 is large, kinetic energy of particles of electrons, ions, and gases constituting the discharge increases.

Therefore, these particles frequently come in contact with the insulator 162 in a period when the discharge adheres to the insulator 162, and as a result, the insulator 162 may be damaged.

Therefore, under the condition that it is determined that the discharge that has become the electrical breakdown state is not in the elongated state, the frequency of the AC voltage is also changed to the third predetermined frequency fC which can maintain the electrical breakdown state of the discharge, and higher than the first predetermined frequency fA.

Thereby, the secondary current flowing between the discharge electrodes can be kept small, and the kinetic energy of the particles of electrons, ions, and gases constituting the discharge can be kept low.

As a result, the insulator 162 can be suppressed from being damaged by the discharge adhering to the insulator 162.

The condition for setting the electrical breakdown flag to OFF was limited to the case where it was determined that the ignition signal IGt was not received in the above embodiment and the examples described in [Example 1] and [Example 2].

With respect to this, the value of the envelope measured when it is determined that the discharge has become electrical breakdown is set as the initial value, and a threshold of which a change amount with respect to the initial value becomes larger than the first predetermined change amount is provided.

Then, when the envelope becomes larger than the threshold value, the electrical breakdown flag may be set to OFF by determining that the discharge is not in the electrical breakdown state.

When the secondary current required for maintaining the discharge cannot be supplied due to excessive elongation of the discharge, it is impossible to maintain the discharge occurring between the discharge electrodes of the spark plug 16, so that a blow-off may occur.

It is assumed that a change amount in the secondary current measured when the discharge is blown off is larger than the change amount in the secondary current of the discharge that has become the electrical breakdown state, and more specifically, it is assumed to be larger than the first predetermined change amount.

Therefore, the change amount relative to the initial value of the threshold value is set to be larger than the first predetermined change amount.

As a result, when the envelope exceeds the threshold value, the discharge is blown out, and it becomes possible to determine that that it is no longer in the electrical breakdown state.

What is claimed is:

1. An ignition device comprising:

a spark plug that generates a plasma discharge between a pair of discharge electrodes for igniting a combustible mixture in a combustion chamber of an internal combustion engine;

an ignition coil having a primary coil and a secondary coil that applies a voltage between the pair of discharge electrodes of the spark plug by the secondary coil;

a measurement value detecting section that detects at least one measurement value among a primary current flowing through the primary coil, a primary voltage applied to the primary coil, a secondary current flowing through the ignition plug, and a secondary voltage applied to the spark plug;

an electrical breakdown determiner that determines whether or not a discharge between the pair of discharge electrodes has become an electrical breakdown state based on the measurement value detected by the measurement value detecting section;

an AC voltage applying section that applies an AC voltage of a first predetermined frequency, which causes voltage resonance in a circuit including the spark plug and the secondary coil, in the primary coil; and a first changing section that changes the frequency of the AC voltage outputted by the AC voltage applying section to a second predetermined frequency that is configured to maintain the electrical breakdown state, and is lower in frequency than the first predetermined frequency when a determination has been made by the electrical breakdown determiner that the discharge has become the electrical breakdown state, wherein, the ignition device includes an envelope acquiring section that acquires an envelope of the measurement value detected by the measurement value detecting section; and the electrical breakdown determiner determines that the discharge has become the electrical breakdown state under a condition that a change amount per unit time of the envelope is larger than a first predetermined change amount in a state where a determination has been made that the discharge has not become the electrical breakdown state.

2. The ignition device according to claim 1, wherein, the electrical breakdown determiner determines that the discharge has become the electrical breakdown state under a condition that a change amount per unit time of the envelope is larger than the first predetermined change amount in a state in which a determination has not been made that the discharge has become the electrical breakdown state; and after a determination has been made that the discharge has become the electrical breakdown state, a value of the envelope when a determination has been made that the discharge has become the electrical breakdown state is set to an initial value, a threshold value is set such that a change amount with respect to the initial value is a change amount larger than the first predetermined change amount, and when the envelope is larger than the threshold value, the electrical breakdown determiner determines that the discharge is no longer in the electrical breakdown state.

3. The ignition device according to claim 1, wherein, the first predetermined frequency is a resonance frequency at which the voltage resonance in the circuit including the spark plug and the secondary coil becomes the strongest.

4. The ignition device according to claim 1, wherein, the measurement value detecting section detects a measured value of a primary current flowing through the primary coil or a primary voltage applied to the primary coil.

5. The ignition device according to claim 1, wherein, the measurement value detecting section detects a measured value of a secondary current flowing through the spark plug or a secondary voltage applied to the spark plug.

6. The ignition device according to claim 1, wherein, the ignition device includes an elongation state determiner that determines whether or not the discharge in an elongated state of which the discharge is elongated based on the measurement value detected by the measurement value detector under a condition that the discharge is determined by the electrical breakdown determination section to have become the electrical breakdown state;

the AC voltage applying section applies the AC voltage of the first predetermined frequency to the primary coil under a condition that the elongation state determiner determines that the discharge is not in the elongated state; and the first changing section changes the frequency of the AC voltage to the second predetermined frequency under a condition that the elongation state determiner determines that the discharge is in the elongated state.

7. The ignition device according to claim 6, wherein, the ignition device includes an envelope acquiring section that acquires an envelope of the measurement value detected by the measurement value detecting section;

the electrical breakdown determiner determines that the discharge has become the electrical breakdown state under a condition that a change amount per unit time of the envelope is larger than the first predetermined change amount in a state in which a determination has not been made that the discharge has become the electrical breakdown state;

the elongated state determiner sets the value of the envelope to an initial value when a determination has been made by the electrical breakdown determiner that the discharge has become the electrical breakdown state, and determines that the discharge has become the elongated state when a change amount of the envelope with respect to the initial value is greater than the second predetermined change amount which is set smaller than the first predetermined change amount.

8. The ignition device according to claim 1, wherein, the ignition device includes an elongation state determiner that determines whether or not the discharge in an elongated state of which the discharge is elongated based on the measurement value detected by the measurement value detector under a condition that the discharge is determined by the electrical breakdown determination section to have become the electrical breakdown state;

a second changing section that changes the frequency of the AC voltage outputted by the AC voltage applying section to a third predetermined frequency that is configured to maintain the electrical breakdown state, and is higher in frequency than the first predetermined frequency when a determination has been made under a condition that the elongation state determiner determines that the discharge is not in the elongated state; and the first changing section changes the frequency of the AC voltage to the second predetermined frequency under a condition that the elongation state determiner determines that the discharge is in the elongated state.

9. An ignition device comprising:

a spark plug that generates a plasma discharge between a pair of discharge electrodes for igniting a combustible mixture in a combustion chamber of an internal combustion engine;

an ignition coil having a primary coil and a secondary coil that applies a voltage between the pair of discharge electrodes of the spark plug by the secondary coil;

a measurement value detecting section that detects at least one measurement value among a primary current flowing through the primary coil, a primary voltage applied to the primary coil, a secondary current flowing through the ignition plug, and a secondary voltage applied to the spark plug;

an electrical breakdown determiner that determines whether or not a discharge between the pair of discharge electrodes has become an electrical breakdown state based on the measurement value detected by the measurement value detecting section;

an AC voltage applying section that applies an AC voltage of a first predetermined frequency, which causes voltage resonance in a circuit including the spark plug and the secondary coil, in the primary coil; and a first changing section that changes the frequency of the AC voltage outputted by the AC voltage applying section to a second predetermined frequency that is configured to maintain the electrical breakdown state, and is lower in frequency than the first predetermined frequency when a determination has been made by the electrical breakdown determiner that the discharge has become the electrical breakdown state, wherein, the ignition device includes an elongation state determiner that determines whether or not the discharge in an elongated state of which the discharge is elongated based on the measurement value detected by the measurement value detector under a condition that the discharge is determined by the electrical breakdown determination section to have become the electrical breakdown state;

the AC voltage applying section applies the AC voltage of the first predetermined frequency to the primary coil under a condition that the elongation state determiner determines that the discharge is not in the elongated state; and the first changing section changes the frequency of the AC voltage to the second predetermined frequency under a condition that the elongation state determiner determines that the discharge is in the elongated state.

10. The ignition device according to claim 9, wherein, the ignition device includes an envelope acquiring section that acquires an envelope of the measurement value detected by the measurement value detecting section;

the electrical breakdown determiner determines that the discharge has become the electrical breakdown state under a condition that a change amount per unit time of the envelope is larger than the first predetermined change amount in a state in which a determination has not been made that the discharge has become the electrical breakdown state;

the elongated state determiner sets the value of the envelope to an initial value when a determination has been made by the electrical breakdown determiner that the discharge has become the electrical breakdown state, and determines that the discharge has become the elongated state when a change amount of the envelope with respect to the initial value is greater than the second predetermined change amount which is set smaller than the first predetermined change amount.

11. An ignition device comprising:

a spark plug that generates a plasma discharge between a pair of discharge electrodes for igniting a combustible mixture in a combustion chamber of an internal combustion engine;

an ignition coil having a primary coil and a secondary coil that applies a voltage between the pair of discharge electrodes of the spark plug by the secondary coil;

a measurement value detecting section that detects at least one measurement value among a primary current flowing through the primary coil, a primary voltage applied to the primary coil, a secondary current flowing through the ignition plug, and a secondary voltage applied to the spark plug;

an electrical breakdown determiner that determines whether or not a discharge between the pair of discharge electrodes has become an electrical breakdown state based on the measurement value detected by the measurement value detecting section;

an AC voltage applying section that applies an AC voltage of a first predetermined frequency, which causes voltage resonance in a circuit including the spark plug and the secondary coil, in the primary coil; and a first changing section that changes the frequency of the AC voltage outputted by the AC voltage applying section to a second predetermined frequency that is configured to maintain the electrical breakdown state, and is lower in frequency than the first predetermined frequency when a determination has been made by the electrical breakdown determiner that the discharge has become the electrical breakdown state, wherein, the ignition device includes an elongation state determiner that determines whether or not the discharge in an elongated state of which the discharge is elongated based on the measurement value detected by the measurement value detector under a condition that the discharge is determined by the electrical breakdown determination section to have become the electrical breakdown state;

a second changing section that changes the frequency of the AC voltage outputted by the AC voltage applying section to a third predetermined frequency that is configured to maintain the electrical breakdown state, and is higher in frequency than the first predetermined frequency when a determination has been made under a condition that the elongation state determiner determines that the discharge is not in the elongated state; and the first changing section changes the frequency of the AC voltage to the second predetermined frequency under a condition that the elongation state determiner determines that the discharge is in the elongated state.

* * * * *